US008297904B1

(12) United States Patent
Schroeder

(10) Patent No.: US 8,297,904 B1
(45) Date of Patent: Oct. 30, 2012

(54) CONTAINER CARRIER

(75) Inventor: Matthew Wendell Schroeder, Ventura, IA (US)

(73) Assignee: Stellar Industries, Inc., Garner, IA (US)

( * ) Notice: Subject to any disclaimer, the term of this patent is extended or adjusted under 35 U.S.C. 154(b) by 218 days.

(21) Appl. No.: 12/592,449

(22) Filed: Nov. 25, 2009

(51) Int. Cl.
*B66F 9/16* (2006.01)

(52) U.S. Cl. ..... 414/642; 414/471; 414/477; 414/541; 414/631

(58) Field of Classification Search ..... 414/462, 414/471, 477, 541, 549, 629, 631, 634, 635
See application file for complete search history.

(56) References Cited

FOREIGN PATENT DOCUMENTS

GB 2153339 A * 8/1985
* cited by examiner

*Primary Examiner* — Saul Rodriguez
*Assistant Examiner* — Willie Berry, Jr.
(74) *Attorney, Agent, or Firm* — G. Brian Pingel; Camille L. Urban; David M. Breiner

(57) ABSTRACT

A container carrier provided with longitudinal extension and retraction capability such that loads may be shifted forward in order to achieve optimal front-to-rear weight distribution on the supporting vehicle. Two hydraulic cylinders having the same rod and bore size are provided in an over and under configuration and act in unison and enable the fork structure to tilt as well as telescopically extend and retract about a mast assembly. The upper cylinder directly controls the angle of the forks while the lower cylinder acts on a mast assembly to extend and retract. A third cylinder is provided for vertically raising and lowering the fork structure so that containers may be picked up from and/or lowered onto elevated surfaces, as well as tilted up and raised toward the truck.

12 Claims, 8 Drawing Sheets

CONTAINER CARRIER

CROSS-REFERENCE TO RELATED APPLICATIONS

None

BACKGROUND OF THE INVENTION

1. Field of the Invention

The present invention relates generally to a container lift and carrying apparatus, and to vehicles adapted to operate as container lifts and carriers. Specifically, the invention relates to a lifting and carrying apparatus for containers that, in addition to conventional lifting and tilting capability, is provided with longitudinal extension and retraction capability such that loads may be shifted so as to achieve better front-to-rear weight distribution about the vehicle on which the apparatus is supported.

2. Description of the Prior Art

By way of background, conventional container carriers can typically lift and tilt but tend to be longitudinally fixed, which minimizes the amount of weight that may be transferred to the front axle of the vehicle to which the carrier is attached.

SUMMARY OF THE INVENTION

Presently disclosed is a container carrier provided with longitudinal extension and retraction capability such that loads may be shifted forward in order to achieve optimal front-to-rear weight distribution on the supporting vehicle. Two hydraulic cylinders having the same rod and bore size are provided in an over and under configuration. The cylinders act in unison and enable the fork structure to tilt as well as telescopically extend and retract. The upper cylinder directly controls the angle of the forks while the lower cylinder acts on a mast assembly to extend and retract. The apparatus provides the ability to operate the cylinders independently to permit precise movements. A third cylinder is provided for vertically raising and lowering the fork structure so that containers may be picked up from and/or lowered onto elevated surfaces, as well as tilted up and raised toward the truck. The apparatus features a novel hydraulic manifold and circuit in order to facilitate the coordination and interaction of the dual cylinders. The forks may be operated so as to be maintained parallel with the ground as they retract and upon the container being lifted.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF THE PREFERRED AND OTHER EMBODIMENTS

While the making and using of various embodiments of the present invention are discussed in detail below, it should be appreciated that the invention provides for inventive concepts capable of being embodied in a variety of specific contexts. The specific embodiments discussed herein are merely illustrative of specific manners in which to make and use the invention and are not to be interpreted as limiting the scope of the present invention.

Figure 1:
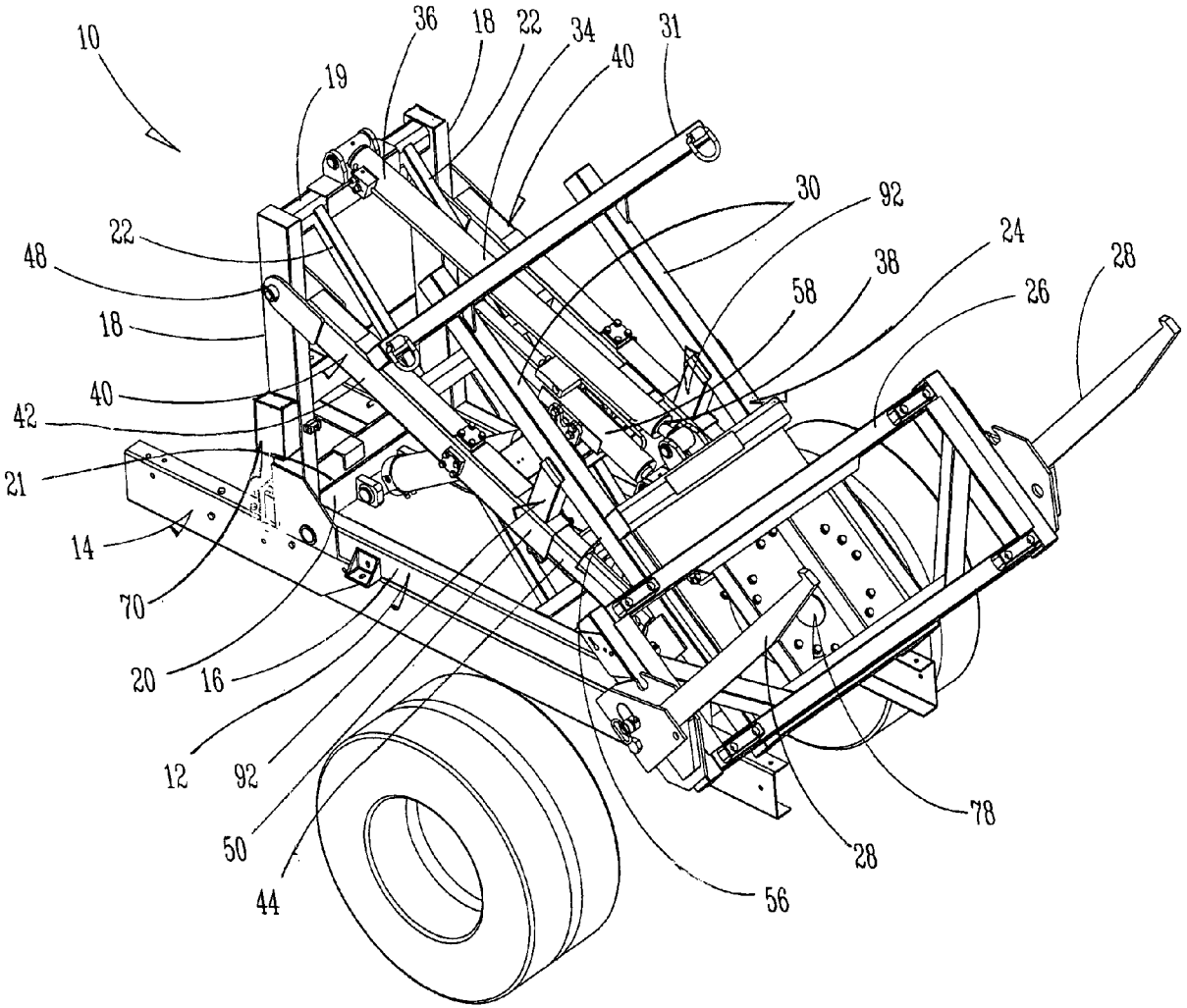
FIG. 1 is a rear side perspective view of a preferred embodiment of the present invention.

As depicted in FIG. 1, apparatus 10 comprises a frame 12 mounted atop the chassis of a vehicle 14. While vehicle 14 may be any type of suitable conveyance, a medium to heavy duty truck chassis having a GVW rating of at least 30,000 lbs. is preferred. Apparatus 10 may also be portable or freestanding, depending on the nature of the use.

Frame 12 comprises horizontal frame members 16 and vertical frame members 18 and upper and lower interconnecting members 19 and 21 that connect the frame members 18 together. Frame members 18 extend vertically from and substantially perpendicular to horizontal frame members 16, creating a junction 20 having a roughly 90-degree angle. In some embodiments, frame 12 may also comprise diagonal supports 22 which extend from horizontal frame members 16 to vertical frame members 18. Supports 22 are preferably positioned at one end roughly midway between junction 20 and the distal end of horizontal frame members 16, and at a second end at or near the end of vertical frame members 18 distal from junction 20, but the precise location of supports 22 about the rest of frame 12 may vary.

Referring now to FIGS. 1-5, situated adjacent frame 12 and distally from junction 20 is fork assembly 24. Fork assembly 24 comprises fork frame 26 and at least one fork 28. Fork frame 26 further comprises a pair of masts 30 which extend generally perpendicularly away from the base of fork frame 26 and away from fork 28 and a cross arm 31 mounted on said masts. In a preferred embodiment, two coplanar forks 28 extend perpendicularly away from the base of fork frame 26 to engage a standard type container 32, not shown, designed to be picked up by the apparatus 10 or other known devices. As is well known in the art, forks 28 may be tilted upward toward fork frame 26 for stowage when not in use, in which case forks 28 are manually lowered into position for use and, optionally, secured into place using a pin or similar locking mechanism.

First hydraulic cylinder 34 has a barrel 36 and a piston rod 38 as is conventional and known in the art. Using means that are also conventional and well known, barrel 36 is pivotably attached to the upper connecting member 19 of vertical frame member 18. Piston rod 38 is pivotably attached to fork assembly 24. Preferably, piston rod 38 is attached roughly midway along the vertically extending masts 30 of fork frame 26.

Apparatus 10 further comprises a pair of telescoping masts 40. Each of the masts 40 comprises a sleeve 42 and an extension 44 slidably disposed within sleeve 42. Sleeves 42 are substantially coplanar and parallel, and are separated by at least one piece of rigid inner framework 46 (see FIG. 3). Inner framework 46 may comprise a singular member such as a bar or a plurality of interconnected structural members such as a grid, lattice or frame. Each sleeve 42 has a first end 48 and a second end 50. First end 48 of sleeve 42 is pivotably attached to vertical frame member 18, preferably below the point of attachment of barrel 36 of first hydraulic cylinder 34.

Each extension 44 has a proximal end 52 and a distal end 54, with proximal and distal referring to the relative position of that end to sleeve 42 when extension 44 is extended. The true proximal end 52 of extension 44 will of course remain within sleeve 42 and thus, herein, proximal end will also generally refer to that portion of extension 44 that is exposed yet nearest second end 50 of sleeve 42. Distal end 54 is pivotably attached to fork assembly 24. Specifically, distal end 54 is pivotably attached to fork frame 26 at or near masts 30 (seen best in FIG. 2), preferably below the point of attachment of piston rod 38 of first hydraulic cylinder 34.

In a preferred embodiment, two extensions 44 are provided, each having a distal end 54. Separating distal ends 54 is a rigid linking member 56. Linking member 56 may be a single bar or a plurality of interconnected structural members such as a grid, lattice or frame. Both distal ends 54 are connected to fork assembly 24 in the same fashion as the single distal end described above. It will be appreciated that in the case of two distal ends 54, one distal end 54 may be attached to each mast 30 of fork frame 26. The lateral distance between parallel masts 40 and parallel masts 30 is preferably the same or only slightly varied.

Second hydraulic cylinder 58 has a barrel 60 and a piston rod 62. Second hydraulic cylinder 58 is conventional and known in the art, and is preferably of the same rod and bore size as first hydraulic cylinder 34. Using means that are also conventional and well known, barrel 60 is attached to the upper surface of sleeve 42. In a preferred embodiment, two sleeves 42 are present and barrel 60 is attached to, and roughly centrally about inner framework 46. Barrel 60 may be attached to sleeve 42, or alternatively to inner frame work 46, anywhere relative to the length of sleeve 42 between its first end 48 and second end 50.

Figure 2:
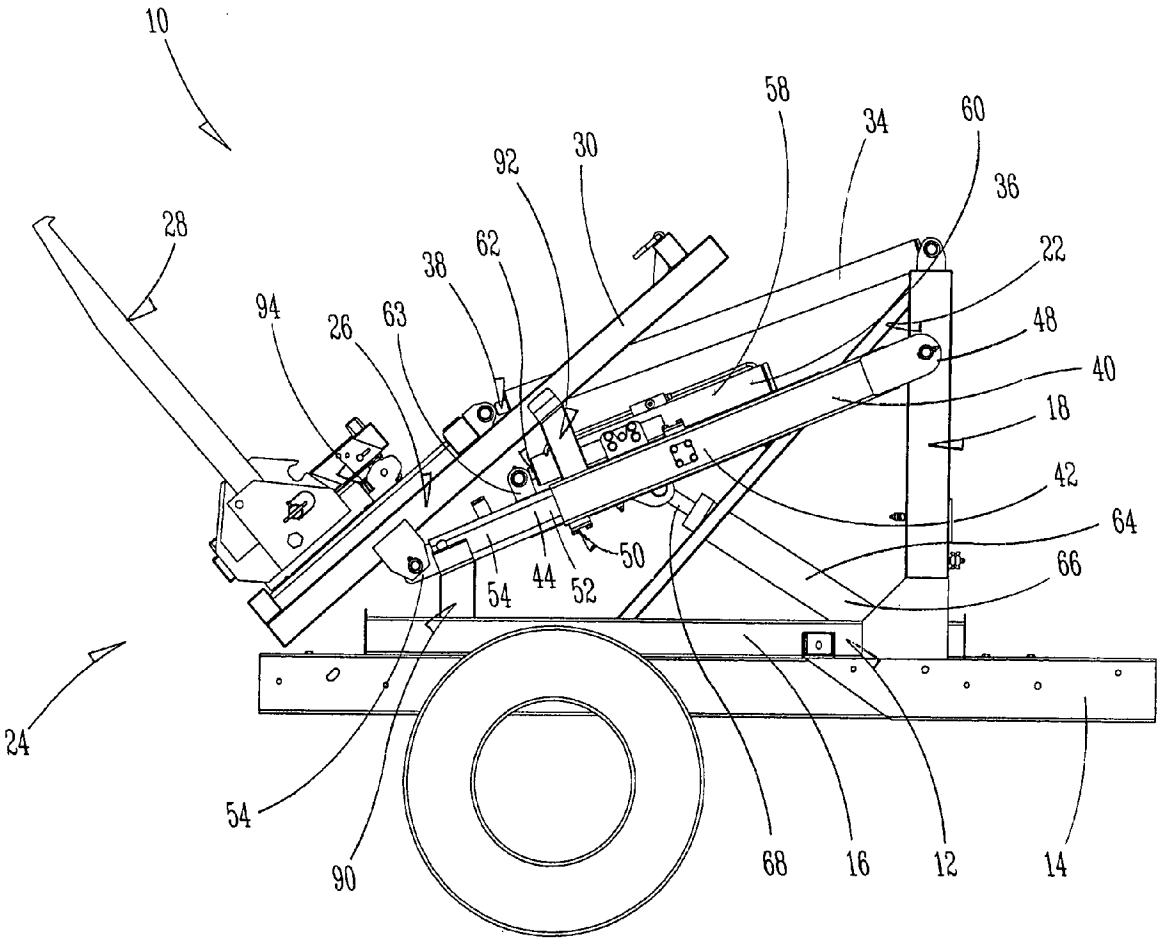
FIG. 2 is a side view of the embodiment of FIG. 1.
Figure 3:
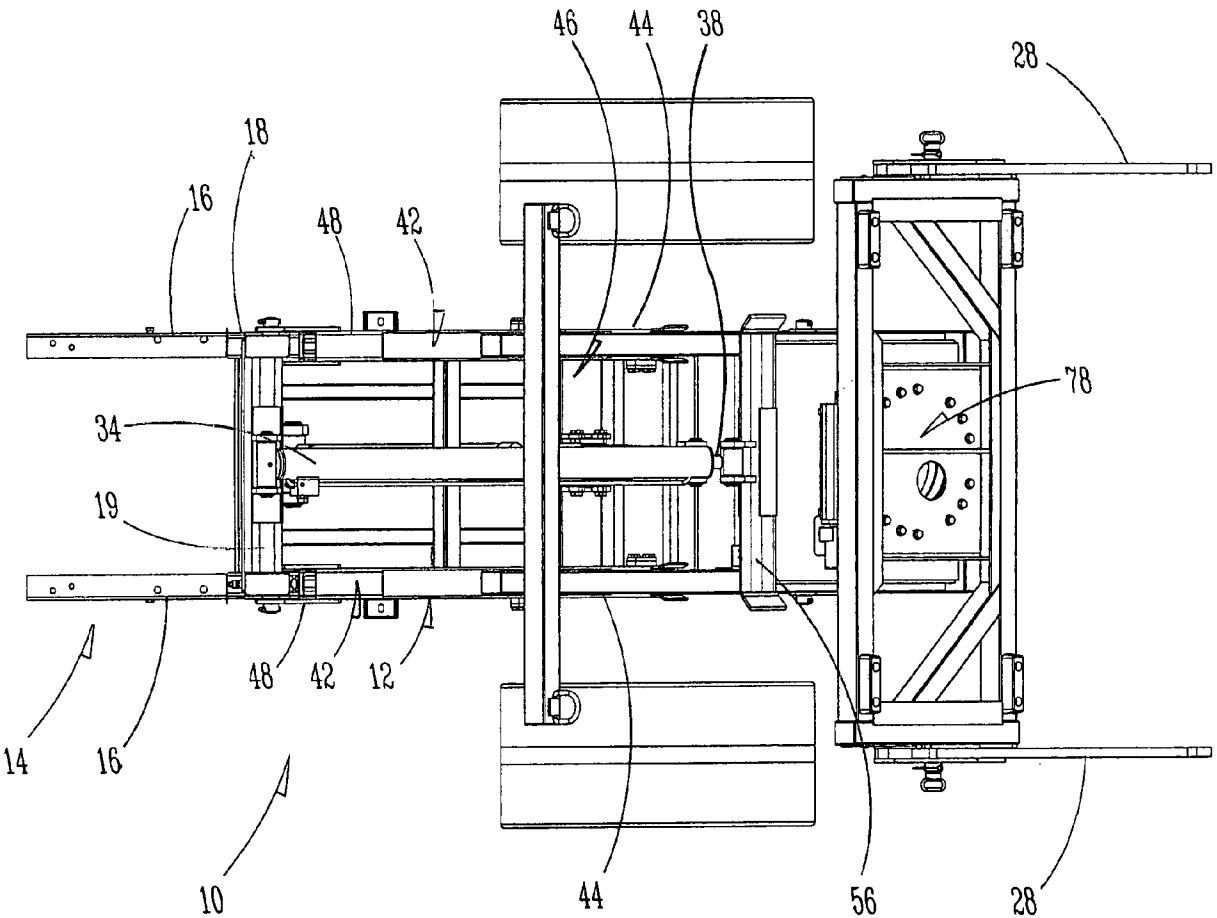
FIG. 3 is a top plan view of the embodiment of FIG. 1.

It will be appreciated that the attachment between barrel 60 and sleeve 42 may comprise a single point of attachment or a plurality of spaced-apart attachments, and that such attachment or attachments may be elongate and may secure as much of barrel 40 to sleeve 42 as desirable. Piston rod 62 is pivotably attached as seen in FIG. 2 at 63 to distal end 54 of extension 44. In a preferred embodiment, two extensions 44 are present and piston rod 62 is pivotably attached to, and roughly centrally about, linking member 56.

First hydraulic cylinder 34 and second hydraulic cylinder 58 are preferably in an over-and-under configuration such that when viewed from above, first hydraulic cylinder 34 is positioned directly over second hydraulic cylinder 58.

It will be appreciated that the actuation of second hydraulic cylinder 58 will result in the extension or retraction of the masts 40. In other words, as piston rod 62 of second hydraulic cylinder 58 extends, by virtue of its attachment to distal end 54 of extension 44, extension 44 will slide and extend outwardly from sleeve 42. As mast 40 extends, fork assembly 24 will also move outward from apparatus 10 by virtue of the attachment between distal ends 54 of extensions 44 and fork frame 26. Likewise, as piston rod 62 retracts, mast 40 and fork assembly 24 will similarly retract.

A third hydraulic cylinder 64 has a barrel 66 and a piston rod 68. Barrel 66 of third hydraulic cylinder 64 is attached to frame 12 to lower cross member 21. Third hydraulic cylinder 64 is preferably tilted upward at an angle of approximately 45 degrees, thereby roughly bisecting the angle between horizontal frame members 16 and vertical frame members 18. Piston rod 68 of third hydraulic cylinder 64 is pivotably attached to the underside of sleeve 42 opposite barrel 60 of second hydraulic cylinder 58. In a preferred embodiment, two sleeves 42 are provided and piston rod 68 of third hydraulic cylinder is pivotably attached to, and roughly centrally about, inner framework 46. As with barrel 60, piston rod 68 may be attached to sleeve 42, or alternatively to inner frame work 46, anywhere relative to the length of sleeve 42 between its first end 48 and second end 50.

While barrel 60 and piston rod 68 may be attached to sleeve 42 or inner framework 46 at approximately the same location above and below, respectively, this is not a requirement or limitation.

Figure 6:
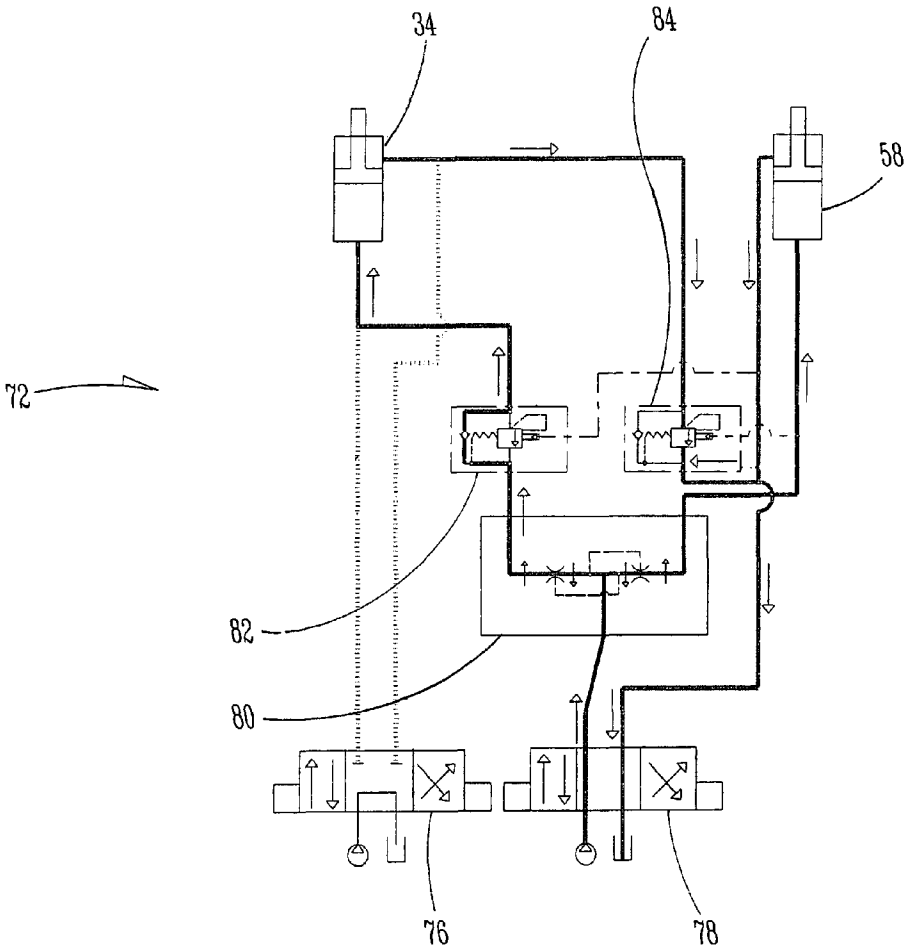
FIG. 6 is a schematic view of a hydraulic circuit included in the embodiment of FIG. 1.

Control means 70 is provided on or near frame 12. Duplicate control means (not shown) may be provided on the opposite side of frame 12 or even in the cab of vehicle 14 for convenience and ease of operation. Control means 70 preferably comprises one or more levers that are operably linked via at least one hydraulic control circuit 72 as shown in FIG. 6 to first, second and third hydraulic cylinders 34, 58 and 64, respectively.

It will be appreciated that, relative to apparatus 10 and fork assembly 24, first hydraulic cylinder 34 acts as a means of tilting, second hydraulic cylinder 58 acts as means of extending, and third hydraulic cylinder 64 acts as a means of lifting. In other words, extending first cylinder 34 engages the top of fork assembly 24 and causes fork assembly 24 to tilt forward/downward about its pivotable connection with mast 40, while retracting first cylinder 34 causes fork assembly 24 to tilt backward/upward about the same connection.

Extending second cylinder 58 engages distal end 54 of extension 44 of mast 40, which is connected to fork frame 26 of fork assembly 24, and causes mast 40 to extend, thereby forcing fork assembly 24 outward. Retracting second cylinder 58 accordingly causes fork assembly 24 to move inward.

Extending third cylinder 64 engages sleeve 42 of mast 40, and causes mast 40, which is again connected to fork frame 26 of fork assembly 24, to be raised about its pivotable connection with frame 12. Likewise, retracting third cylinder 64 causes mast 40 and fork assembly 24 to be lowered.

Hence, for purposes of this discussion, first cylinder 34 may be referred to interchangeably as the "tilt" cylinder, second cylinder 58 may be referred to interchangeably as the "extend" cylinder, and third cylinder 64 may be referred to interchangeably as the "lift" cylinder. An objective of the present invention is to provide operation of the tilt and extension operations simultaneously to provide better front to rear weight distribution. Thus, the control circuit 72 is designed to allow the tilt and extend operations to be performed independently in isolation, in a predetermined sequence, or simultaneously depending on the circumstances and requirements and to achieve a desired result as will now be described.

Referring now to FIG. 6, hydraulic control circuit 72 for controlling the tilt cylinder 34 and the extend cylinder 58 is shown in schematic detail. Such circuit is designed to allow the tilt cylinder 34 and the extend cylinder 58 to be actuated simultaneously or to allow the tilt cylinder to be controlled independently by itself. It should be recognized that the apparatus 10 also includes hydraulic circuitry for controlling the lift cylinder 64, which circuit is a standard hydraulic circuit for extending and retracting the cylinder 64 as is well-known in the art.

Figure 7:
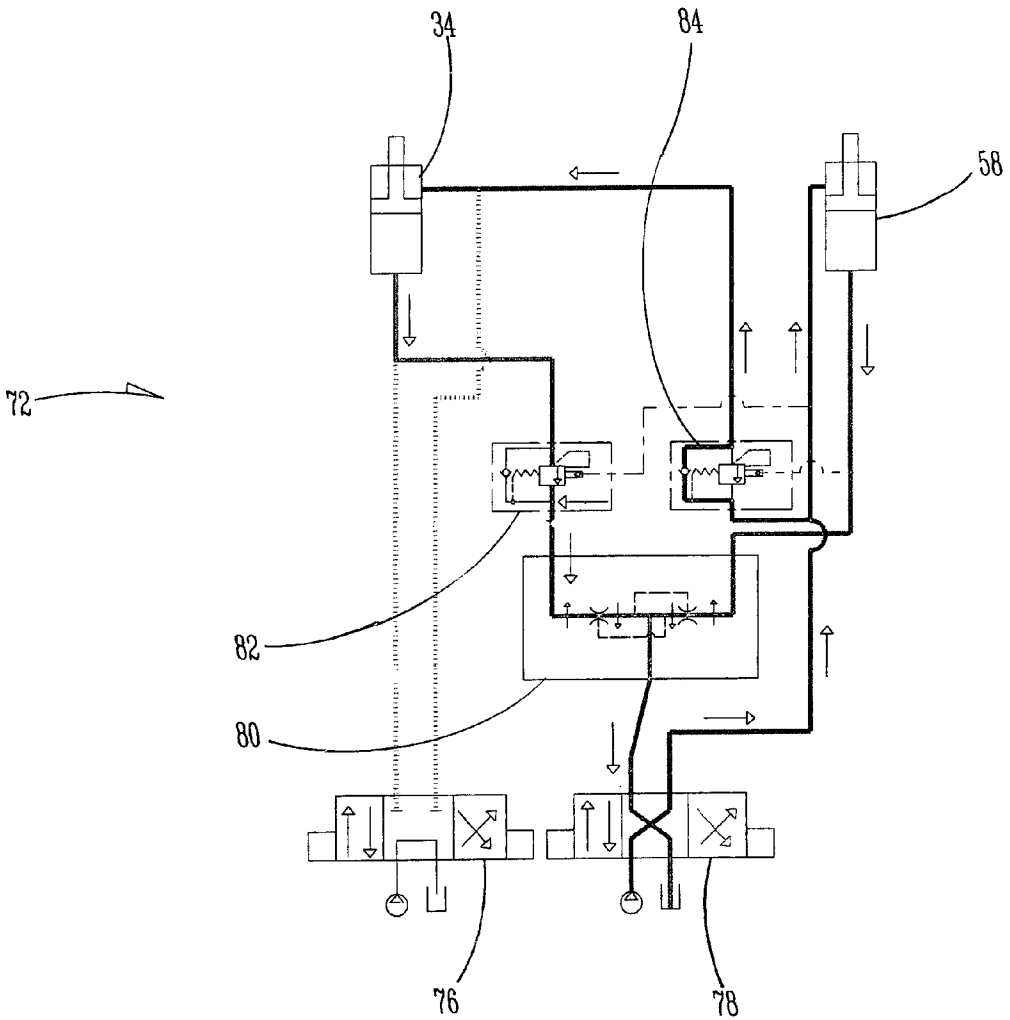
FIG. 7 is another schematic view of the circuit of FIG. 6.
Figure 8:
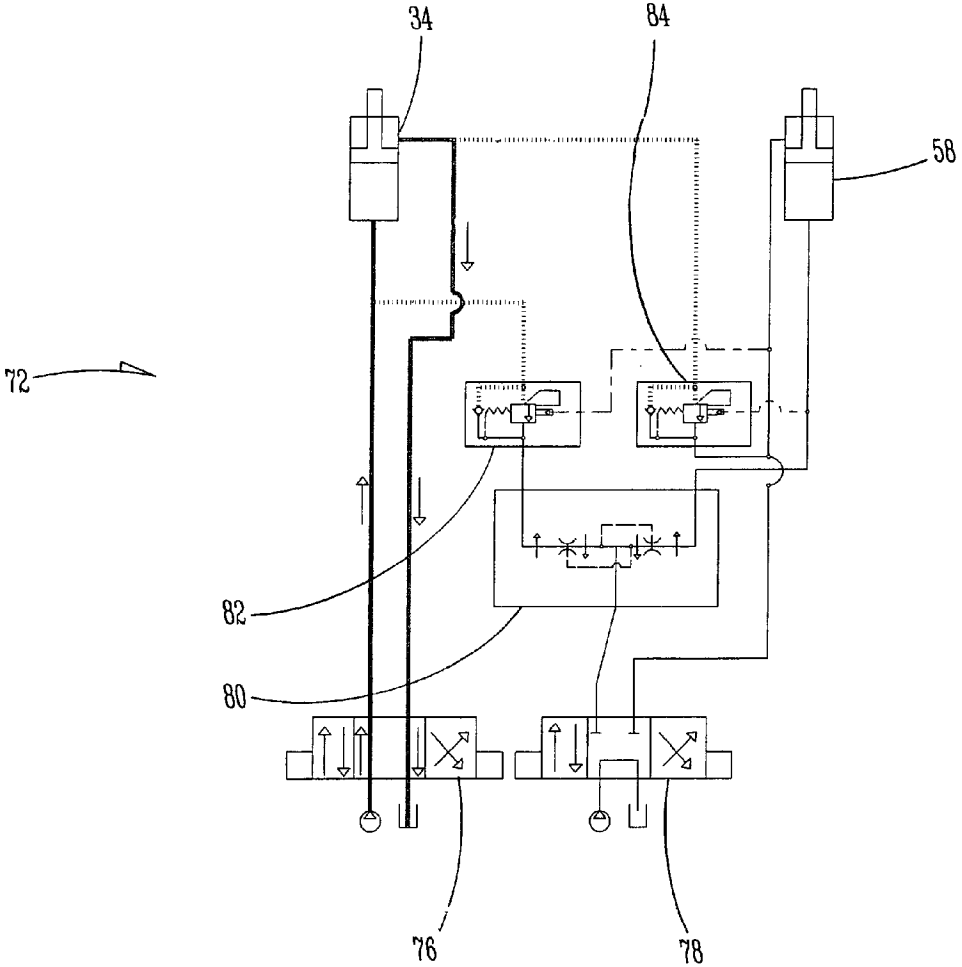
FIG. 8 is yet another schematic view of the circuit of FIG. 6.

Included in the circuit 72 are a tilt control valve 76, an extension control valve 78, a flow divider 80, counter balance valves 82 and 84, and the various hydraulic lines for interconnecting these components to the tilt cylinder 34 and the extend cylinder 58. As shown in FIG. 6, the extension control valve has been actuated to cause the cylinders 34 and 58 to extend their respective piston rods 38 and 62 outwardly. As further shown therein, fluid flow passes through the control valve 76 to the flow divider 80 which divides such flow into two paths, one to the barrel end 36 of the tilt cylinder 34 and one to the barrel end 60 of the extend cylinder 58 to actuate the same. The flow to the tilt cylinder 34 passes through the counter balance valve 82 to reach the tilt cylinder 34 and the return flow path for the tilt cylinder 34 is through the counter balance valve 84 that is opened by pilot pressure from the supply hydraulic line leading to the barrel 60 of the extend cylinder 58. To retract the cylinders 34 and 58 simply requires a reversal of the fluid flow as indicated in FIG. 7, with the counter balance valve 82 now being controlled by pilot pressure from the supply line for the rod end of the cylinder 58. Thus, by using the counter balance valves 82 and 84, hydraulic fluid is only provided to the tilt cylinder 34 if the hydraulic fluid can flow through both counter balance valves 82 and 84. This mode of operation contrasts sharply with the independent operation of the tilt cylinder 34 as indicated in FIG. 8.

To operate the tilt cylinder 34 independent of the extend cylinder 58 requires actuation of the tilt control valve 76 to supply hydraulic fluid to the barrel 36 of the cylinder 34. Although the hydraulic line communicating between the tilt control valve 76 and the tilt cylinder 34 is in fluid communication with the line between the counter balance valve 82 and the tilt cylinder 34, fluid flow to the remainder of the circuit 72 is prevented by the counter balance valve 82 which is in a closed condition. Thus, actuation of the tilt control valve 76 results in only an extension or retraction of the tilt cylinder 34.

As a result of the unique operation of the apparatus 10 by means of the circuit 72, a variety of different operations may be utilized for lifting, moving and setting down the container 32. For example, or lifting operation, vehicle 14 is positioned, preferably by backing up, vis-à-vis container 32. Forks 28, if tilted and upright, are lowered into position roughly parallel with the ground by actuation of tilt cylinder 34 and guided into position about the container 32, usually into elongate channels externally located on either side of the container body. Prior to engaging the container 32, the height of forks 28 may need to be adjusted. Using control means 70, and via hydraulic control circuit 72, lift cylinder 64 is actuated until forks 28 reach the desired height. In the event that the pitch of forks 28 needs to be adjusted, tilt cylinder 34 is actuated until forks 28 reach the desired angle.

Figure 4:
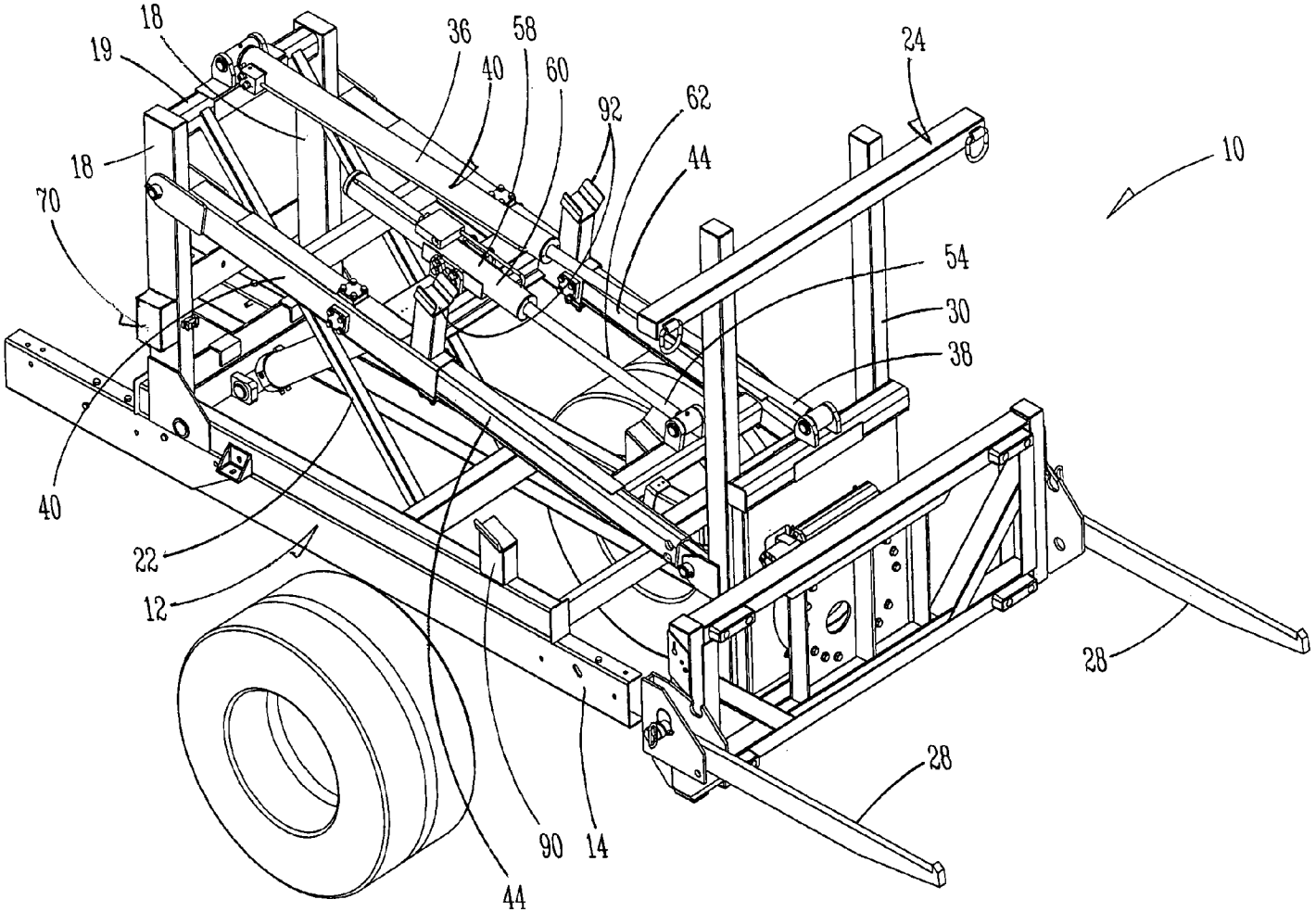
FIG. 4 is another rear side perspective view of the embodiment of FIG. 1.
Figure 5:
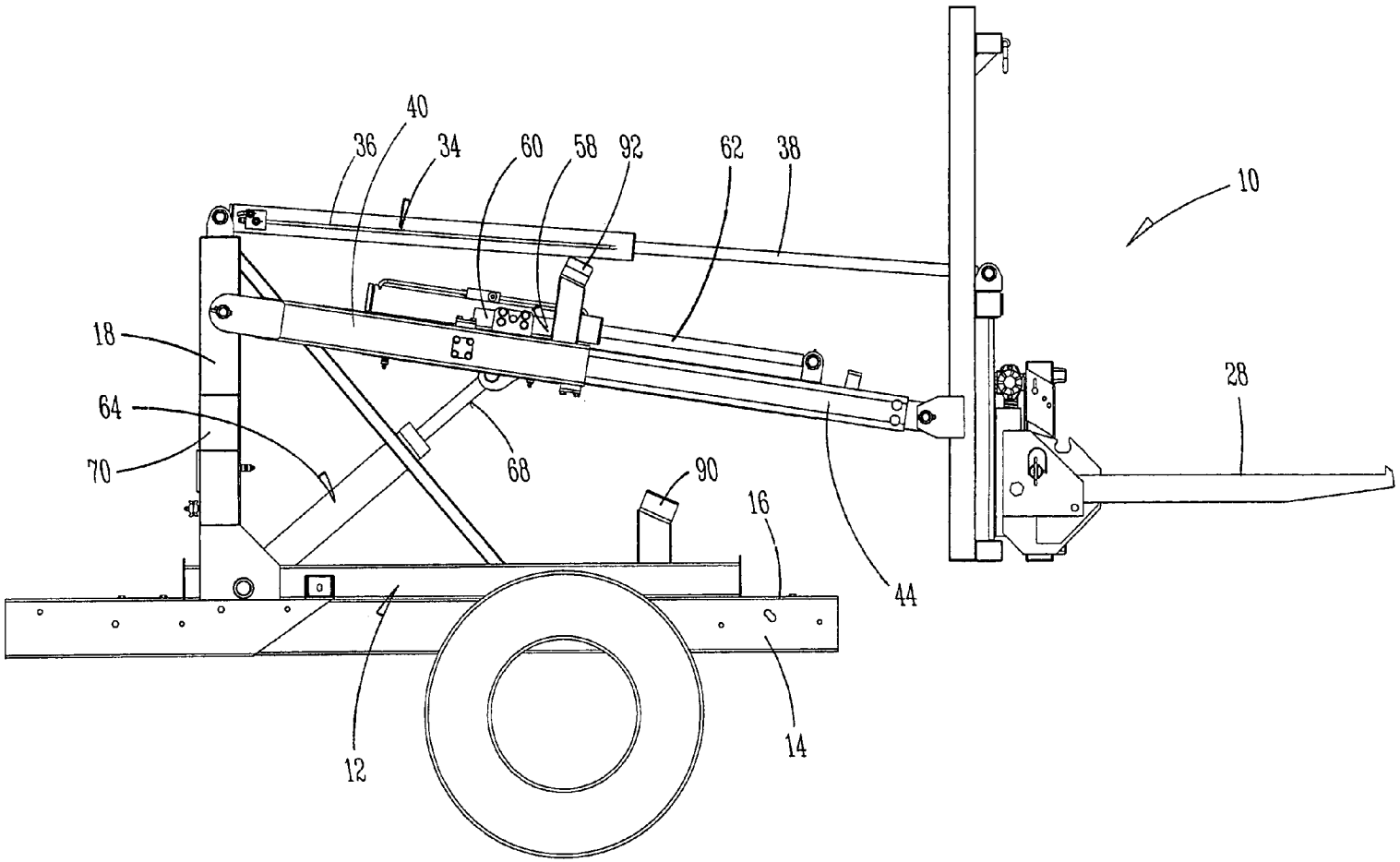
FIG. 5 is another side view of the embodiment of FIG. 1.

In some instances, vehicle 14 may be backed up sufficiently far so as to permit forks 28 to engage container 32. In other situations, such as where there is a curb or other surface obstacle, fork assembly 24 will need to be extended toward container 32. Using control means 70, and via hydraulic control circuit 72, extend cylinder 58 is actuated until forks 28 are properly engaged with container 32, as depicted in FIG. 4. The pitch of forks 28 may be adjusted as needed via actuation of tilt cylinder 34.

Lift cylinder 64 is then actuated so as to raise container 32 off of the ground. Tilt cylinder 34 may be actuated to tilt container 32 backward. Extend cylinder 58 may be actuated so as to shift the load of container 32 forward about vehicle 14 by retracting mast 40. As is well known in the art, better front-to-rear weight distribution significantly improves safety and handling. Lift cylinder 64 is then actuated to lower container 32 for transport.

During lifting operation, tilt cylinder 34 may also be used to maintain the container 32 in a constant level state. This is accomplished by extending lift cylinder 64 and simultaneously—and at a comparative rate—extending extend cylinder 58. It will be appreciated that even though mast 40 is raising about a fixed axis (junction 20 of frame 12), container 32 will remain substantially level because fork assembly 24 is being tilted forward.

The container 32 may be lowered onto a surface that is lower or higher than the surface from which it was previously retrieved. If container 32 is to be placed on an elevated surface, once vehicle 14 is properly positioned, tilt cylinder 34 is actuated to tilt container 32 forward, preferably until forks 28 are level to the ground. Lift cylinder 64 is actuated to raise container to the desired height. Vehicle 14 is backed and/or extend cylinder 58 is actuated to extend mast 40 until container 32 is centered over the desired placement. Lift cylinder 64 is then actuated to lower container 32. During lowering operation, tilt cylinder 34 is actuated as needed to maintain container 32 in a level state. Once container 32 is placed, forks 28 are tilted to clear the channels on container 32. Vehicle 14 is advanced, and/or mast 40 is retracted via extend cylinder 58.

As is well known in the art, apparatus 10 may be adapted to engage a variety of containers 32. In some rear-load applications, fork assembly 24 will be fitted with trunnion slots (not shown) to engage trunnion bars (not shown) on a container. The operation of apparatus 10 is substantially the same, the only difference being that the trunnion slots of fork assembly 24 engage container 32 instead of forks 28.

Optionally, horizontal frame member 16 may be fitted with one or more rest stands 90 (see FIG. 4) which are adapted to receive a distal end 54 of extension 44 of mast 40 when mast 40 is fully lowered (at rest). Rest stands 90 are preferably located distally from junction 20 and preferably comprise a shelf or channel upon or in which distal end 54 will rest.

Likewise, sleeve 42 of mast 40 may be fitted with one or more rest stands 92 (see FIG. 4) which are adapted to receive a mast 30 of fork frame 26 when fork assembly 24 is fully tilted backward. Rest stands 92 are preferably located proximate second end 50 of sleeve 42 and preferably comprise a shelf or channel upon or in which mast 30 will rest.

The fork assembly 24 may further comprise means 94 for rotating relative to, about, and independently of apparatus 10, such as in dumping or emptying operations. Means 94, which are conventional and known in the art, preferably comprises a motor, a bearing swing drive, and a means for controlling the motor. Means 94 may be controllable via control means 70 and hydraulic control circuit 72.

Thus, the present invention has been described in an illustrative manner. It is to be understood that the terminology that has been used is intended to be in the nature of words of description rather than of limitation. Furthermore, whereas the present invention has been described in relation to the drawings attached hereto, it should be understood that other and further modifications, apart from those shown or suggested herein, may be made within the spirit and scope of this invention.

I claim:

1. An apparatus for lifting and transporting containers comprising:

a frame having spaced apart horizontal frame members with forward and rearward ends and spaced apart vertical frame members extending upwardly above and substantially perpendicular thereto, said vertical frame members being connected together by at least an upper interconnecting member;

a fork assembly including at least one fork;

at least one tilt hydraulic cylinder having a barrel pivotably attached to said frame, and a piston rod pivotably attached to said fork assembly so that extension of said tilt cylinder causes the fork assembly to pivot;

a telescoping mast comprising a sleeve and an extension slidably disposed therein, said sleeve having a first end and a second end, and said extension having a proximal end and a distal end;

wherein said first end of said sleeve is pivotably attached to said frame and said distal end of said extension is pivotably connected to said fork assembly;

at least one extend hydraulic cylinder having a barrel attached to said sleeve between said first and second ends and a piston rod attached proximate said distal end of said extension so that as the piston rod of said extend cylinder is moved outward, such extension moves relative to said sleeve to move the fork assembly rewardly from a retracted position to an extended position whereby the fork assembly is positioned rewardly of the rear ends of said horizontal frame members;

at least one lift hydraulic cylinder for vertically raising or lowering said fork assembly;

and control means for selectively actuating said hydraulic cylinders, said control means adapted to alternatively allow the tilt and extend cylinders to be operated simultaneously and further allow the tilt cylinder to be operated independently of the extend cylinder.

2. The apparatus of claim 1 wherein the point of attachment between said first end of said sleeve and said frame is below the point of attachment between said barrel of said tilt hydraulic cylinder and said frame.

3. The apparatus of claim 1 wherein the point of attachment between said distal end of said extension and said fork assembly is below the point of attachment between said piston rod of said tilt hydraulic cylinder and said fork assembly.

4. The apparatus of claim 1 wherein said frame is adapted to be installed on a vehicle chassis.

5. The apparatus of claim 1 wherein said horizontal frame members further comprise a rest stand adapted to receive said distal end of said extension when said mast is lowered.

6. The apparatus of claim 1 wherein said second end of said sleeve further comprises a rest stand adapted to receive said fork assembly when said fork assembly is tilted.

7. The apparatus of claim 1 wherein said telescoping mast comprises two sleeves and two extensions, substantially in parallel, and an inner framework secured to said sleeves, and wherein said distal ends of said two extensions are pivotably connected to said fork assembly at spaced apart locations.

8. The apparatus of claim 7 wherein said barrel of said extend hydraulic cylinder and said piston rod of said lift hydraulic cylinder are attached to said inner framework.

9. The apparatus of claim 8 further comprising a linking member between said distal ends of said extensions, wherein said piston rod of said extend hydraulic cylinder is attached to said linking member.

10. The apparatus of claim 1 wherein said control means includes a hydraulic circuit having two counter balance valves to alternatively allow the tilt and extend cylinders to be operated simultaneously and further allow the tilt cylinder to be operated independently of the extend cylinder.

11. The apparatus of claim 10 wherein said hydraulic circuit includes a flow divider.

12. An apparatus for lifting and transporting containers comprising:

a frame having a horizontal frame member and a vertical frame member substantially perpendicular thereto;

a fork assembly;

a first hydraulic cylinder having a barrel pivotably attached to said vertical frame member, and a piston rod pivotably attached to said fork assembly;

a telescoping mast comprising two parallel sleeves separated by an inner framework, each sleeve having an extension slidably disposed therein;

said sleeves each having a first end and a second end, and said extensions each having a proximal end and a distal end;

a linking member between said distal ends of said extensions;

wherein said first end of said sleeves are pivotably attached to said vertical frame member below said first hydraulic cylinder and said distal ends of said extension are pivotably connected to said fork assembly below said piston rod of said first hydraulic cylinder;

a second hydraulic cylinder having a barrel attached to said inner framework between said first and second ends of said sleeves and a piston rod attached to said linking member between said distal ends of said extensions;

a third hydraulic cylinder having a barrel attached to said frame and a piston rod pivotably attached to said inner framework between said sleeves opposite said barrel of said second hydraulic cylinder; and control means for selectively actuating said hydraulic cylinders, said control means is adapted to alternatively allow the tilt and extend cylinders to be operated simultaneously and further allow the tilt cylinder to be operated independently of the extend cylinder.

* * * * *